US006827233B1

(12) United States Patent
Scallate

(10) Patent No.: US 6,827,233 B1
(45) Date of Patent: Dec. 7, 2004

(54) BUCKET

(76) Inventor: Phillip F. Scallate, 2611 N. Royal Oaks Dr., Beaufort, SC (US) 29902

( * ) Notice: Subject to any disclaimer, the term of this patent is extended or adjusted under 35 U.S.C. 154(b) by 0 days.

(21) Appl. No.: 10/764,151

(22) Filed: Jan. 23, 2004

(51) Int. Cl.[7] ..... B67D 5/00
(52) U.S. Cl. ..... 220/603; 220/736; 220/771
(58) Field of Search ..... 220/603, 736, 220/771

(56) References Cited

U.S. PATENT DOCUMENTS

| | | | | |
|---|---|---|---|---|
| 1,656,799 A | | 1/1928 | Smith | |
| 1,903,185 A | | 3/1933 | Lewis | |
| 2,023,399 A | | 12/1935 | Bullard | |
| 2,444,584 A | | 7/1948 | Touchett | |
| 2,613,860 A | | 10/1952 | Hoffman | |
| 3,805,995 A | * | 4/1974 | Lebel et al. | 220/603 |
| 4,823,433 A | | 4/1989 | Curtis | |
| 4,895,269 A | | 1/1990 | Cade | |
| 4,919,298 A | | 4/1990 | Gregory | |
| 4,927,046 A | | 5/1990 | Armstrong | |
| 4,941,586 A | | 7/1990 | Tarna | |
| 5,050,759 A | * | 9/1991 | Marble | 220/705 |
| 5,054,661 A | | 10/1991 | Hollje | |
| 5,269,438 A | | 12/1993 | Kelsey | |
| 5,310,079 A | | 5/1994 | Sandy et al. | |
| 5,314,061 A | | 5/1994 | Bedrossian | |
| 5,566,861 A | | 10/1996 | Serano | |
| 5,577,631 A | * | 11/1996 | Hooson | 220/603 |
| 5,778,489 A | | 7/1998 | Marshall, II | |

* cited by examiner

*Primary Examiner*—Joseph Man-Fu Moy
(74) *Attorney, Agent, or Firm*—B. Craig Killough

(57) ABSTRACT

A bucket has an upper opening and an interior cavity, a floor having a rear portion and a front portion within the body, and a handle extending upwardly from a first side the body. The handle has a gripping member and a pair of side portions that define a receiver opening, and the handle does not materially extend over the receiver opening. The body is eccentrically weighted by a weight member attached to the first side of the body so that the bucket is balanced when suspended by the handle.

7 Claims, 7 Drawing Sheets

BUCKET

FIELD OF THE INVENTION

The pre sent invention relates generally to containers and, more specifically, it relates to a bucket system for allowing unobstructed insertion of an object into the bucket while providing a balanced bucket.

BACKGROUND OF THE INVENTION

Container such as buckets are known and used. A conventional container is comprised of a cylindrical structure with an interior cavity, a floor and a pivotally attached handle. A removable lid may be attached about the upper opening of the container during non-use. The handle is pivotally attached to the outer side portions of the container and is above a center portion of the container when the user is grasping the handle.

A problem with conventional containers is that the position of the handle makes it extremely difficult to insert an object into the container for accessing and/or removing the contents. For example, the handle obstructs a paintbrush that is in the container to retrieve paint. In addition, when using a conventional paint container, the user's hands typically become covered with paint from the paintbrush during entry and exiting of the container.

The invention allows unobstructed insertion of an object such as a cloth, dipper or paintbrush into the container while an individual comfortably supports the bucket. Conventional container devices do not allow for easy insertion and exiting of such objects from the container, while also providing a container that is balanced when supported by the handle.

In these respects, the bucket or container according to the present invention substantially departs from the conventional concepts and designs of the prior art, and in so doing provides an apparatus primarily developed for the purpose of allowing unobstructed insertion of a paintbrush while an individual comfortably supports the bucket.

SUMMARY OF THE INVENTION

In view of the foregoing disadvantages inherent in the known types of containers now present in the prior art, the present invention provides a new bucket system construction wherein the same can be utilized for allowing unobstructed insertion of an object, and is balanced so that the user may comfortably support the bucket.

The present invention generally comprises a body having an upper opening and an interior cavity, a floor having a rear portion and a front portion within the body, and a handle attached to a front edge of the body. The handle has a gripping member and a pair of side portions that define a receiver opening for comfortably receiving the hand of a user. The body is eccentrically weighted so that the bucket is balanced when suspended by the handle.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a bucket that will overcome the shortcomings of the prior art devices.

A second object is to provide a bucket for allowing unobstructed insertion and removal of an object while an individual comfortably supports the bucket.

Another object is to provide a bucket that reduces the likelihood of material in the bucket being inadvertently applied to the user's hand.

A further object is to provide a bucket that remains balanced during usage.

An additional object is to provide a bucket that increases the efficiency of use.

A further object is to provide a bucket that is comfortable for a user to support.

Another object is to provide a bucket that requires only one hand of a user to support.

An additional object is to provide a bucket that is easy to clean.

Other objects and advantages of the present invention will become obvious to the reader, and it is intended that these objects and advantages are within the scope of the present invention.

To the accomplishment of the above related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
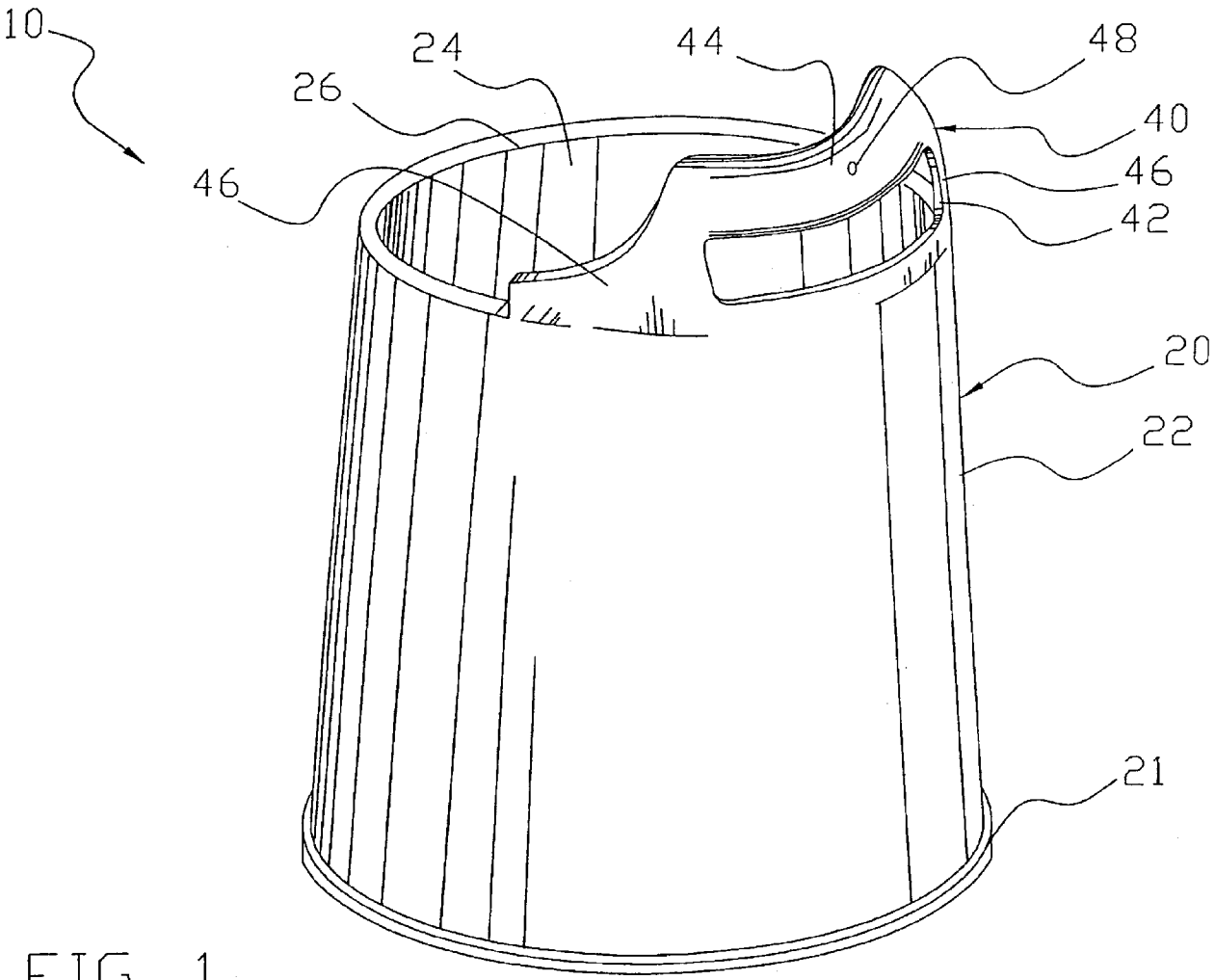
FIG. 1 is a front upper perspective view of the present invention.

Turning now descriptively to the drawings, in which similar reference characters denote similar elements throughout the several views, FIG. 1 through FIG. 8 illustrate a paint bucket system which comprises a body 20 having an upper opening 26 and an interior cavity, a floor 30 having a rear portion 32 and a front portion 34 within the body 20, and a handle 40 attached to a front edge 28 of the body 20. The handle 40 has a gripping member 44 and a pair of side portions 46 that define a receiver opening 42 for comfortably receiving the hand of a user. The rear portion 32 of the floor 30 is thicker than, or is elevated from, the front portion 34, for distributing an increased percentage of the volume of paint within the body 20 toward the front portion 34 thereof to assist in counterbalancing the position of the handle 40.

Figure 2:
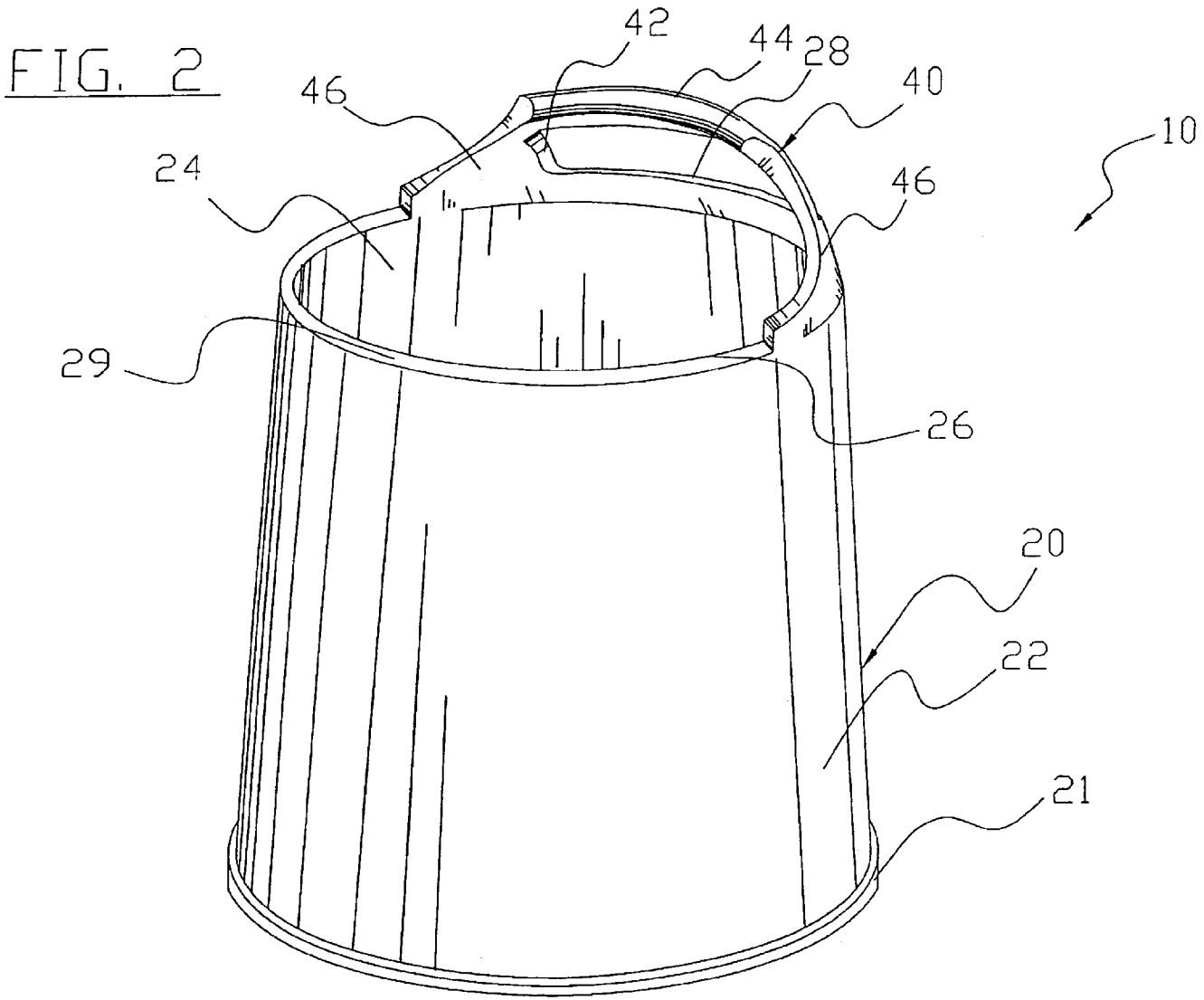
FIG. 2 is a rear upper perspective view of the present invention.
Figure 4:
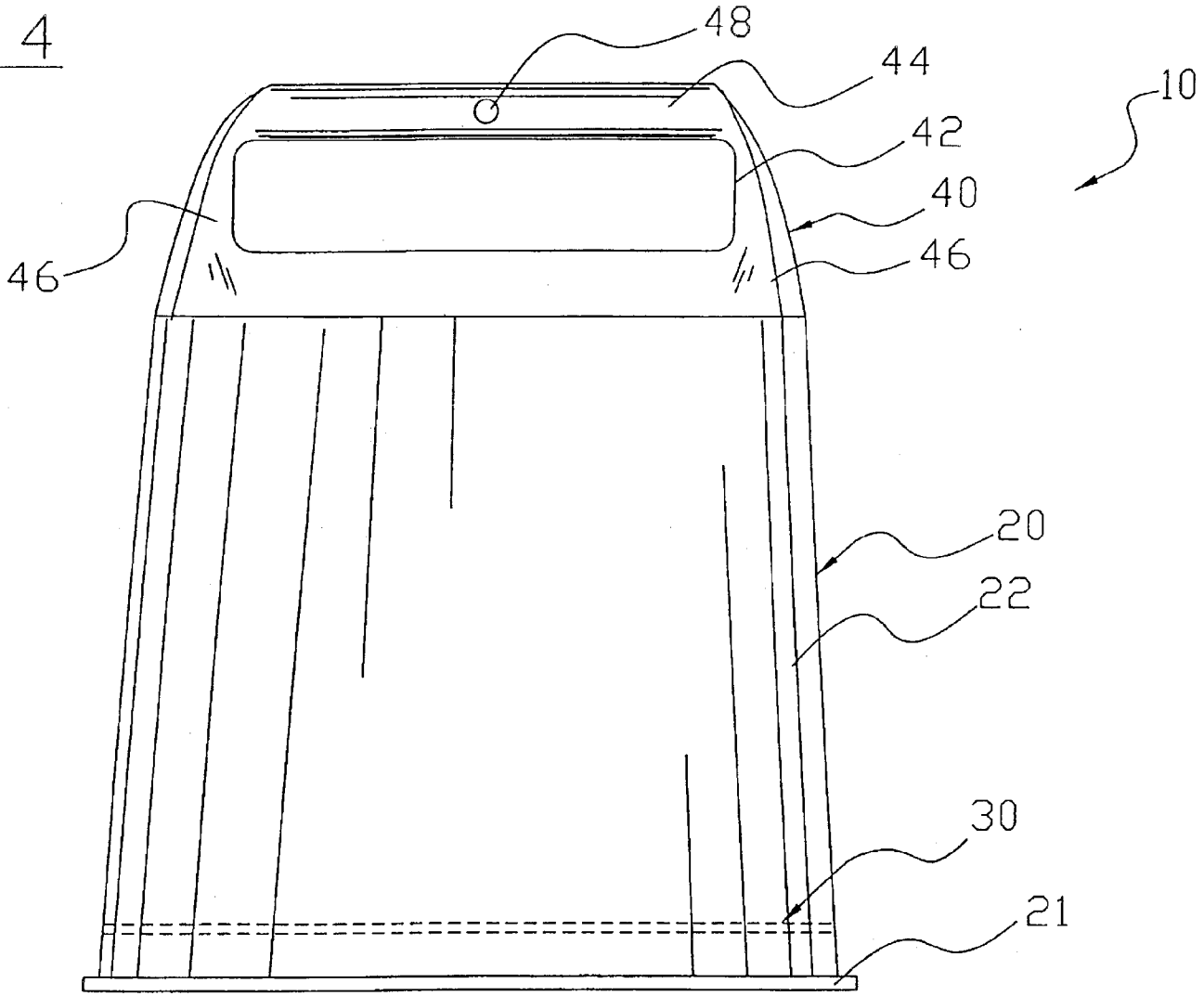
FIG. 4 is a rear view of the present invention.

As shown in FIGS. 1, 2, 4, 5 7, and 8 of the drawings, the body 20 is a cylindrical structure having an outer surface 22 and an inner surface 24. The body 20 may have various shapes and sizes as can be appreciated. The body 20 may be comprised of one or more walls having various cross sectional shapes. The inner surface 24 of the body 20 and the floor 30 define a reservoir for retaining the paint. The body 20 may also be tapered as shown in FIGS. 1, 2 and 4 of the drawings. The body 20 is preferably constructed of a plastic material, however, various other types of materials may be utilized to construct the body 20.

Figure 5:
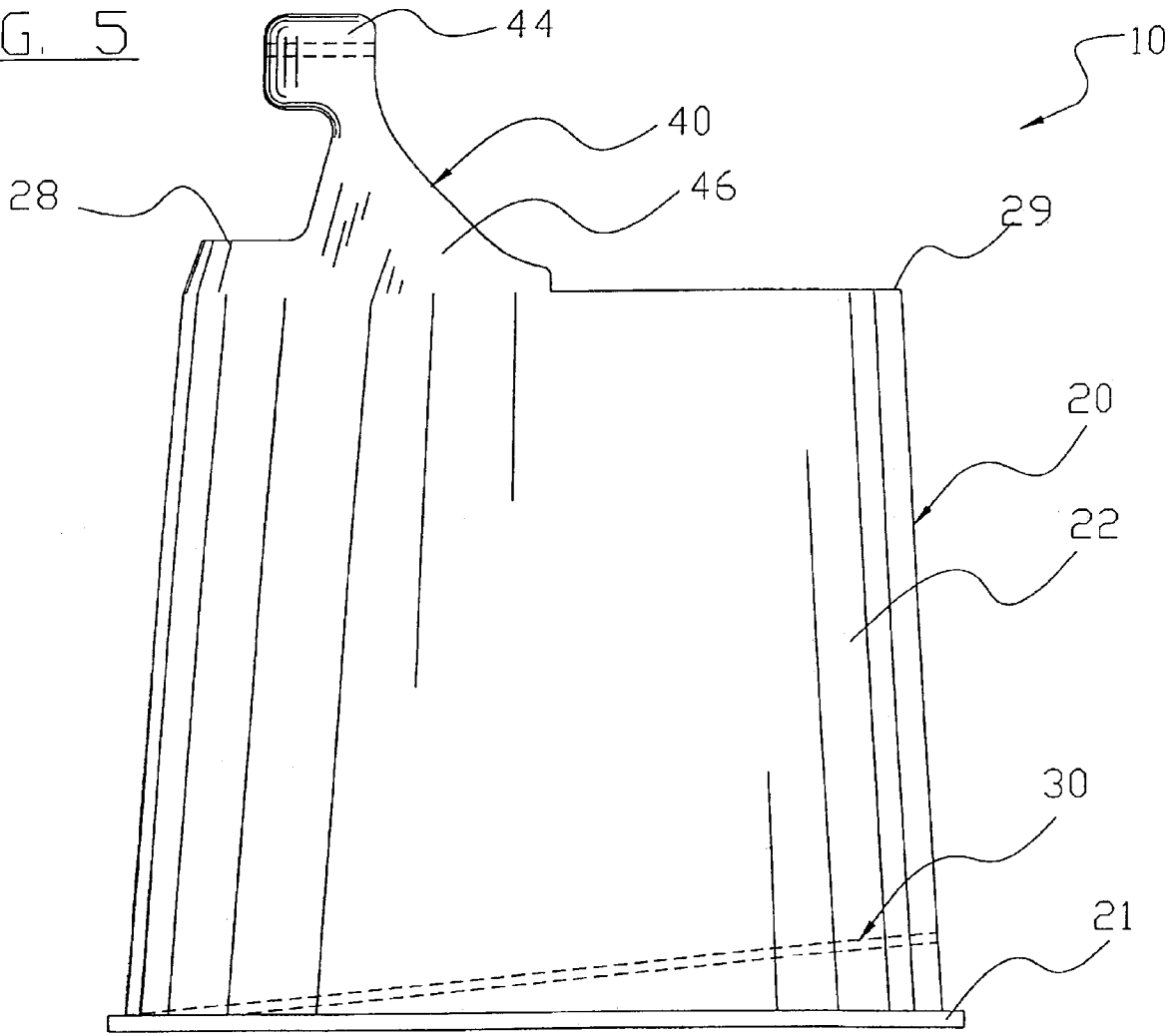
FIG. 5 is a side view of the present invention.

As shown in FIGS. 1 and 2 of the drawings, the body 20 includes an upper opening 26 for receiving the paint and a paintbrush 12. The upper opening 26 is preferably broad enough for allowing a paintbrush 12 to be easily inserted within. The upper opening 26 has a front edge 28 and a rear edge 29 as best shown in FIGS. 3, 5 and 6 of the drawings.

Figure 6:
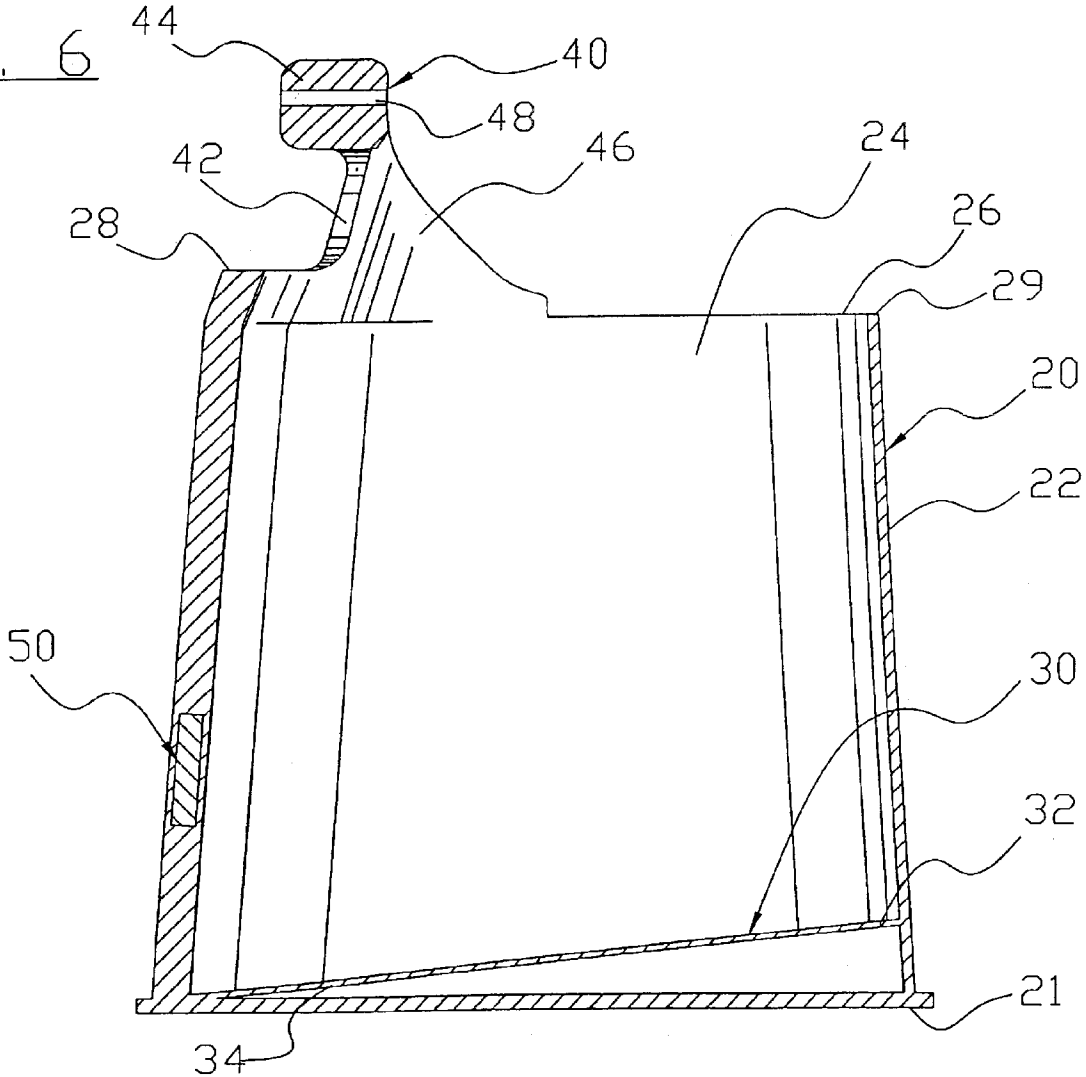
FIG. 6 is a cross sectional view taken along line 6—6 of FIG. 3.
Figure 7:
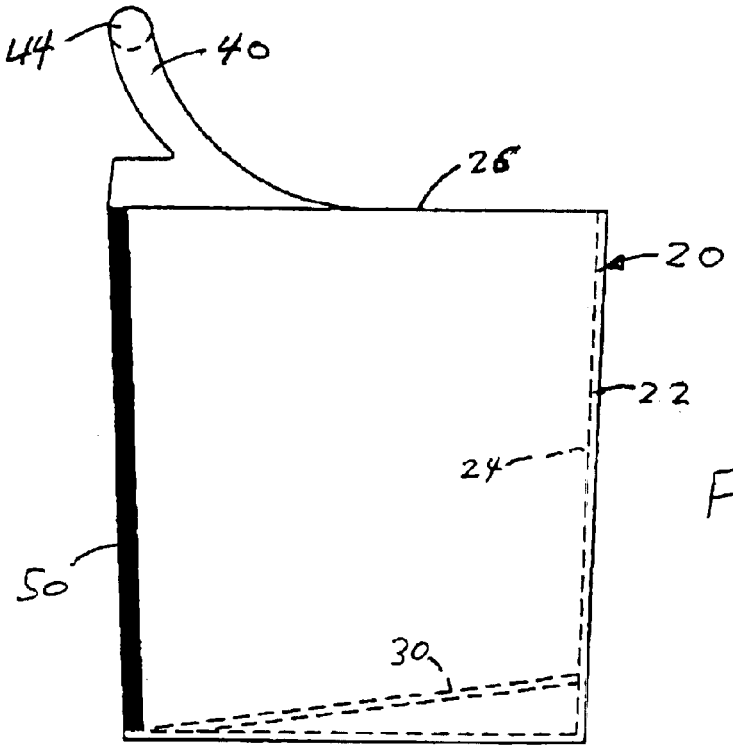
FIG. 7 is a side elevation of an additional embodiment of the present invention.
Figure 8:
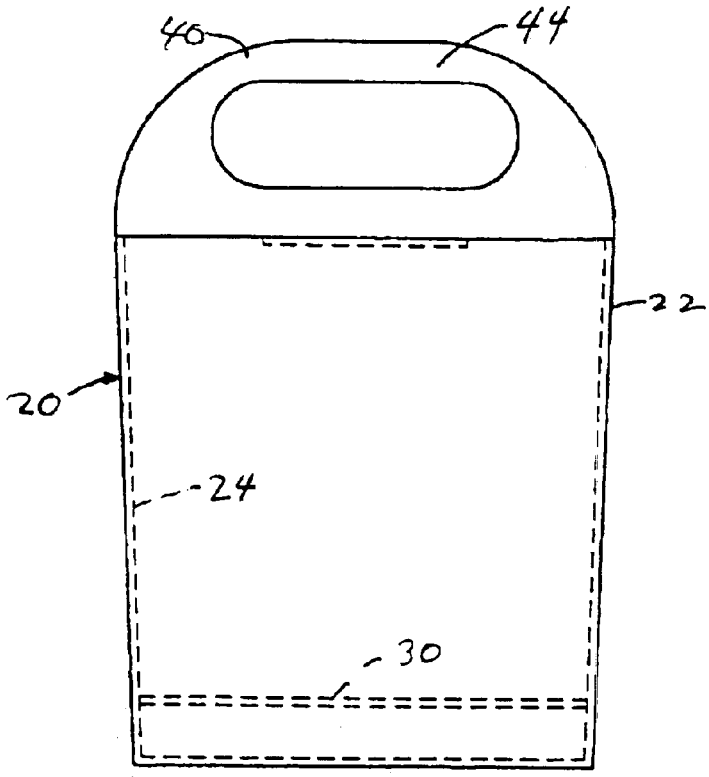
FIG. 8 is a side elevation of the embodiment of FIG. 7, with the bucket rotated ninety degrees from FIG. 7.

As best shown in FIG. 6 and in FIG. 7 of the drawings, the portion of the body 20 adjacent the front edge 28 and the handle 40 preferably has a thicker wall portion that the portion of the body 20 opposite thereof, or an added weight. Weight member 50 may be positioned within the body 20 adjacent the front edge 28 for increasing the weight further on the front side of the handle 40. As shown, the weight 50 is positioned below handle 40 and on the same side of the body as the handle. The thicker portion of the body 20 and/or the added weight increases the weight on the front side of the handle 40, thereby counterbalancing the increased weight of the body 20 and the paint within the rear side of the handle 40. The weight member 50 may be comprised of any well-known material such as but not limited to lead. The weight member 50 may also be attached to the outer surface 22 of the body 20 by utilizing conventional attachment means.

Figure 3:
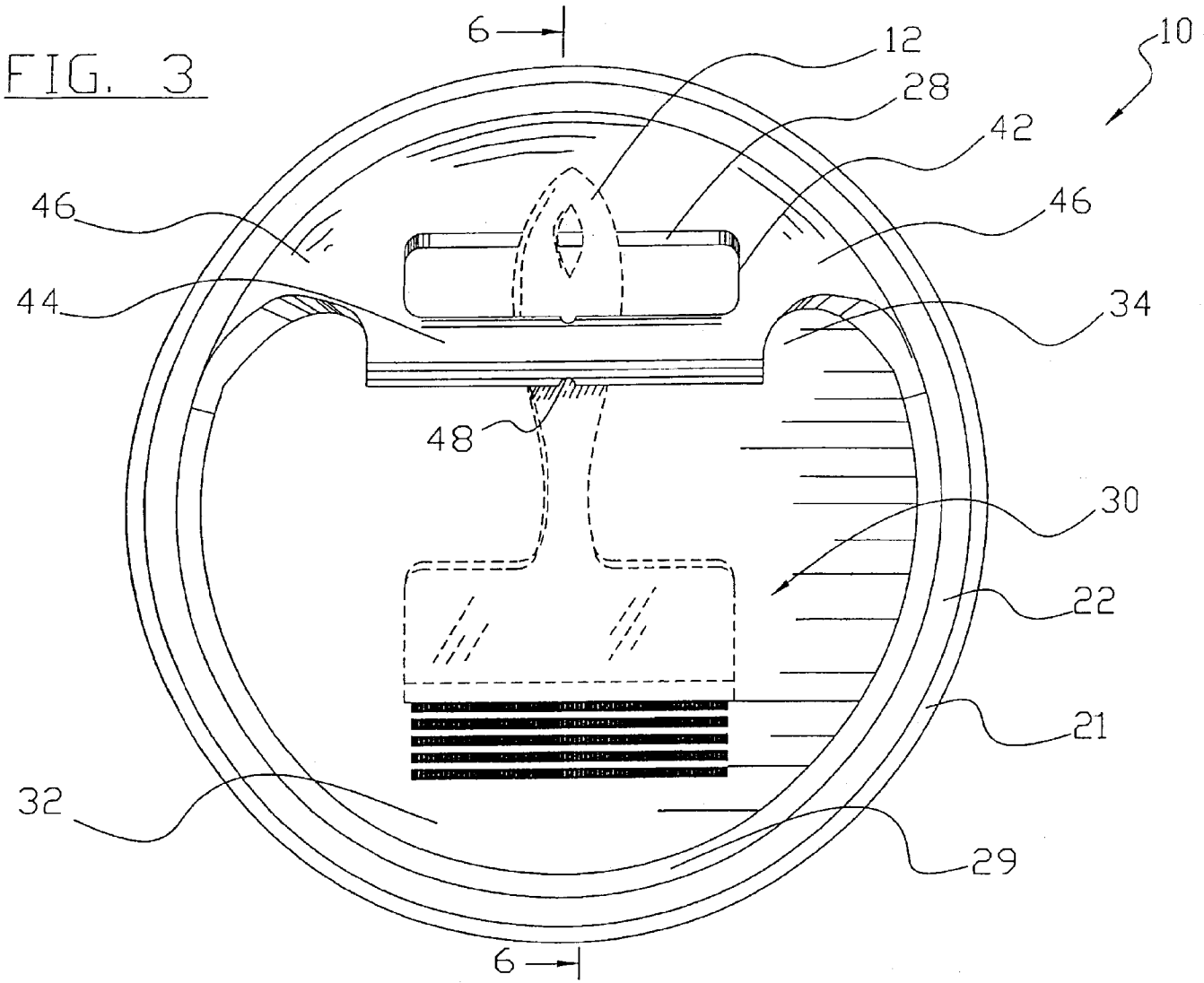
FIG. 3 is a top view of the present invention.

Opposite of the upper opening 26 a floor 30 encloses the lower portion of the body 20 thereby defining the reservoir as best shown in FIGS. 3 and 6 of the drawings. The floor 30 may be comprised of various shapes and designs. The floor 30 has a front portion 34 that is below the front edge 28 and a rear portion 32 that is below the rear edge 29 of the body 20. The floor 30 is preferably angled downwardly from the rear portion 32 toward the front portion 34 thereby decreasing the volume of paint positioned to the rear of the handle 40 within the body 20 as best shown in FIG. 6 of the drawings. A base 21 may be attached to the body 20 opposite of the upper opening 26 as shown in FIGS. 1 through 6 of the drawings.

As shown in FIGS. 1 through 6 of the drawings, the handle 40 is attached to the front edge 28 of the body 20. The handle 40 may have various shapes such as straight or curved. The handle 40 is comprised of a pair of side portions 46 that extend upwardly to support a gripping member 44 with a receiver opening 42 within as best shown in FIGS. 2, 3 and 4 of the drawings. The handle 40 is preferably ergonomic and may include finger grooves. The handle 40 may also include an aperture 48 extending through the gripping member 44 for receiving a hook or other extended member.

As best shown in FIG. 3 of the drawings, the gripping member 44 is positioned closer to the front edge 28 of the body 20 than the rear edge 29 of the body 20 to avoid obstructing the upper opening 26 within the body 20. The position of the gripping member 44 also positions the pivot axis of the body 20 forwardly thereby requiring additional weight within the front portion 34 to maintain the body 20 within a substantially vertical position. As further shown in FIG. 3 of the drawings, the paintbrush 12 may be partially inserted into the receiver opening 42 of the handle 40 thereby supporting the bristles of the paintbrush 12 within the paint thereby engaging the floor 30.

In use, the user inserts paint or other liquid into the body 20 through the upper opening 26. Because the floor 30 is inclined downwardly from the rear portion 32 to the front portion 34, the depth of the paint above the front portion 34 is greater than the depth of the paint above the rear portion 32, thereby effectively increasing the volume and weight of the paint on the front of the gripping member 44 thereby counterbalancing the position of the gripping member 44. In addition, the wall of the body 20 is preferably thicker below the front edge 28, thereby increasing the weight to counterbalance the position of the gripping member 44. Also, a weight member 50 that acts as a counterweight may be positioned on or within the body 20 below the front edge 28 for increasing the weight in front of the gripping member 44. The user grasps the gripping member 44 with their hand and the body 20 maintains a substantially vertical position because of the increased weight to the front of the gripping member 44. When the paintbrush 12 is not in use, the user positions a portion of the paintbrush 12 within the receiver opening 42 for supporting the bristles within the paint to maintain the bristles in a moist condition.

As to a further discussion of the manner of usage and operation of the present invention, the same should be apparent from the above description. Accordingly, no further discussion relating to the manner of usage and operation will be provided. The bucket or container is ideally suited as a paint container, but can be used for other purposes, such as containing cleaning materials, wherein a sponge or similar device may be easily inserted or withdrawn, or the bucket could contain ice or beverages that are removed with tongs or a dipper.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A bucket, comprising:

a) a container portion;

b) a handle extending upwardly from said container portion, and above a first side of said container portion, wherein said handle does not substantially extend over an upper opening of said container portion; and c) a counterweight that is mounted on said first side of container portion and below said handle.

2. A bucket as described in claim 1, wherein said counterweight is mounted on said first side of said container portion so that said upper opening is substantially horizontal when the bucket is suspended from said handle.

3. A bucket as described in claim 1, wherein said bucket comprises a floor that is opposite said opening, and wherein said floor is not parallel to said upper opening.

4. A bucket as described in claim 3, wherein said floor is a flat plane.

5. A bucket as described in claim 1, wherein said bucket comprises a floor that is opposite said opening, and wherein said floor is sloped downwardly toward said first side.

6. A bucket as described in claim 3, wherein said floor is a flat plane that slopes from a side of said container portion that is opposite said first side of said container portion to said first side of said container portion.

7. A bucket as described in claim 1, wherein said bucket comprises a floor that is opposite said opening, and wherein said counterweight is mounted on said first side of said container portion so that said opening is substantially horizontal when the bucket is suspended from said handle.

* * * * *